United States Patent [19]

Lawall

[11] Patent Number: 4,706,927

[45] Date of Patent: Nov. 17, 1987

[54] FORM FOR PRODUCING ARCUATE BORES IN POURED CONCRETE SLABS

[76] Inventor: Robert Lawall, 4200 Bruning Ct., Fairfax, Va. 22032

[21] Appl. No.: 324,868

[22] Filed: Nov. 25, 1981

[51] Int. Cl.[4] ..... B28B 7/16; B28B 7/28; E04G 15/06

[52] U.S. Cl. ..... 249/177; 249/13; 249/39; 249/142; 249/175; 249/188

[58] Field of Search ..... 249/11, 13, 83, 188, 249/39, 142, 177, 175

[56] References Cited

U.S. PATENT DOCUMENTS

| | | | |
|---|---|---|---|
| 1,801,346 | 4/1931 | Heath | 249/175 |
| 2,775,017 | 12/1956 | McDonough | 249/83 |
| 3,123,885 | 3/1964 | Marler | 249/83 |
| 3,265,349 | 8/1966 | Hamrick | 249/177 |
| 3,346,230 | 10/1967 | Tolf | 249/177 |
| 3,758,068 | 9/1973 | Lengel | 249/178 X |
| 4,030,866 | 6/1977 | Madej | 249/83 |
| 4,077,599 | 3/1978 | Oland | 249/177 |
| 4,278,229 | 7/1981 | Burlett | 249/11 |

*Primary Examiner*—Jan H. Silbaugh
*Assistant Examiner*—Karen D. Kutach
*Attorney, Agent, or Firm*—Sherman Levy

[57] ABSTRACT

An arcuate plastic shoe-like sleeve form with an upper open minor end and a lower open major end is provided for attachment by a mounting flange on its major end to a form structure for poured concrete slabs, such as a floor, so that, after concrete is poured and set on the form structure, an arcuate opening is produced in the slab through which a pipe, electrical conduit and the like can be easily threaded as it is moved parallel with the slab and introduced into the opening.

8 Claims, 5 Drawing Figures

FORM FOR PRODUCING ARCUATE BORES IN POURED CONCRETE SLABS

BACKGROUND OF THE INVENTION (1) Field of the Invention:

The present invention generally appertains to improvements in structural concrete forming and especially relates to new and novel improvements in devices for forming or producing openings or bores in concrete slabs, such as floors, ceilings or the like, during the pouring and setting of the concrete.

(2) State of the Prior Art:

The use of reinforced concrete slabs in the construction of buildings has increased to the point that time and expense are important in the pouring thereof and in the installation of pipes, electrical conduits and the like therein after they are set. It is no longer practical or feasible to drill passages or openings in the cured concrete. Thus, present commercial practice dictates that the openings for the pipes, conduits and the like be produced when the concrete is poured.

Many forms or sleeves are to be found in the prior art for accomplishing the production of such openings.

Thus, as early as 1931 an impractical attempt was made in U.S. Pat. No. 1,801,346 but the use of an envelope of textile material stuffed with a sand filler was not feasible.

In U.S. Pat. No. 3,265,349, a longitudinally split sheet metal sleeve is disclosed with the sleeve being adjustable by means connecting its split edges so that it could assume differing diameters.

In U.S. Pat. No. 3,346,230, a telescopic plastic sleeve is disclosed.

In U.S. Pat. No. 3,758,068, a form for molding a tapered bore in concrete is disclosed.

In U.S. Pat. No. 4,077,599, an elongated tubular body is provided with engaging means so as to frictionally secure it in a form holder.

In all instances, except in one impractical embodiment in U.S. Pat. No. 1,801,346, the bore or passageway produced in the slab is straight. This is satisfactory, in some instances, for the movement of pipes or conduits through a slab. But, in many instances difficulties can be faced, For example, in the instance of passing an electrical conduit through a bore or passage in a concrete floor slab—which has been produced by one or the known straight tubular forms to result in a straight tubular bore or passage—it necessitates bending the conduit in a goose-neck design form below the floor slab so as to align the leading end portion of the conduit with the straight axis of the bore.

SUMMARY OF THE INVENTION

The primary object of the present invention is to obviate such difficulties and to provide an arcuate form whereby a substantially arcuate passage or bore is produced in a concrete slab.

A further important object of the present invention is to provide a plastic form of substantially arcuate formation with a minor upper end and a major lower end so that the overall shape of the form is akin to a boot whereby a boot-like passageway or bore is produced in a poured concrete slab. In the case of a floor, the passageway would have a large open bottom and sidewalls tapering to a small top disposed alongside a wall upstanding from the floor. It can be appreciated that an electrical conduit, or any pipe or the like, could be easily threaded into the bottom and cause itself to slide in a curve up to and through the top to be positioned alongside the wall.

Thus, a further object of the present invention is to provide a simple form which will produce a passage or bore in a concrete floor slab or the like whereby conduits, pipes and the like can be threaded into the bottom of the bore while parallel with the slab and which will follow the curvature of the bore and move upwardly into a position perpendicular to the slab.

A still further object of the present invention is to provide a simple, compact, one-piece inexpensive form which can be easily attached to a form for the slab and can be easily removed therefrom after the slab is cured.

DESCRIPTION OF THE PREFERRED EMBODIMENT

Figure 1:
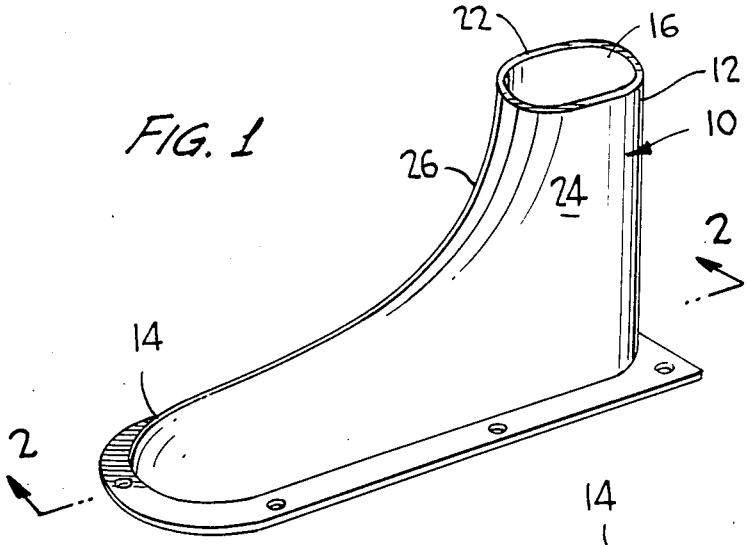
FIG. 1 is a frontal side perspective view of the form of the present invention.
Figure 2:
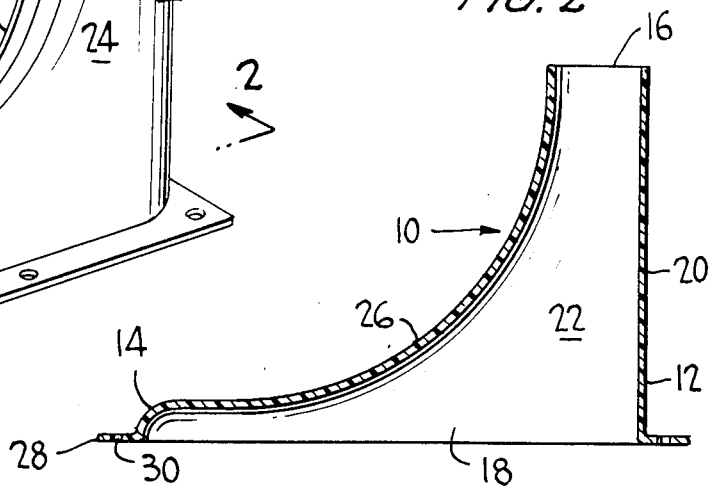
FIG. 2 is a longitudinal vertical sectional view taken on line 2—2 of FIG. 1.

Referring now more particularly to the drawing, and initially to FIGS. 1–2, the sleeve form 10 is of tubular one-piece construction and is formed from suitable plastics materials, such as poly vinyl chloride (PVC) or other polyethylene plastics. The form is generally in the shape of an arcuate boot so that it presents a heel end portion 12 and a tapering toe end portion 14.

Figure 4:
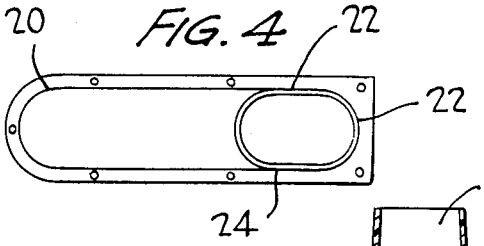
FIG. 4 is a top plan view of the form.

The form 10 has a hollow interior which, in conjunction with the plastics material composition thereof, makes the form extremely lightweight and easy to handle. In its given configuration, the form 10 has an open upper minor end 16 and an open lower major end 18. At the heel end portion 12, the form has a curved rear end wall 20 and opposing side walls 22 and 24 joined at their fronts by a curved front wall 26. The end wall and front wall are of a similar curvature, as shown in FIG. 4. Walls 20 and 26 are similarly curved or contoured, as shown in FIG. 4 with the walls being substantially U-shaped at the upper end of the form and the side walls being straight. The front wall 26 is curved downwardly and slopes outwardly toward the toe end portion 14 and the side walls 22 and 24 are complemental in such curvature so ss to present the rounded and tapered toe end portion 14. The lower end edges of all of the walls are coplanar and terminate in an integral outwardly projecting lateral flange 28 which has vertical apertures 30.

Figure 3:
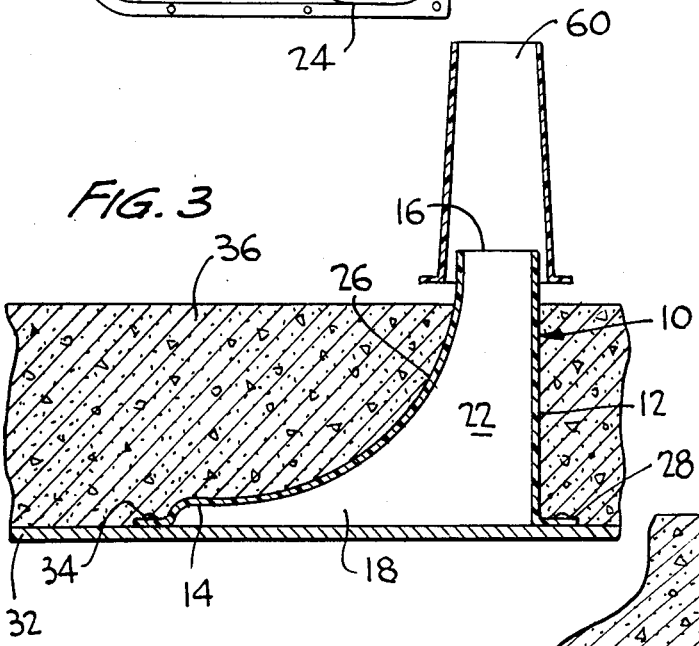
FIG. 3 is a longitudinal vertical cross-sectional view of the form in attachment to a portion of the form on which concrete is poured to produce a floor slab.
Figure 5:
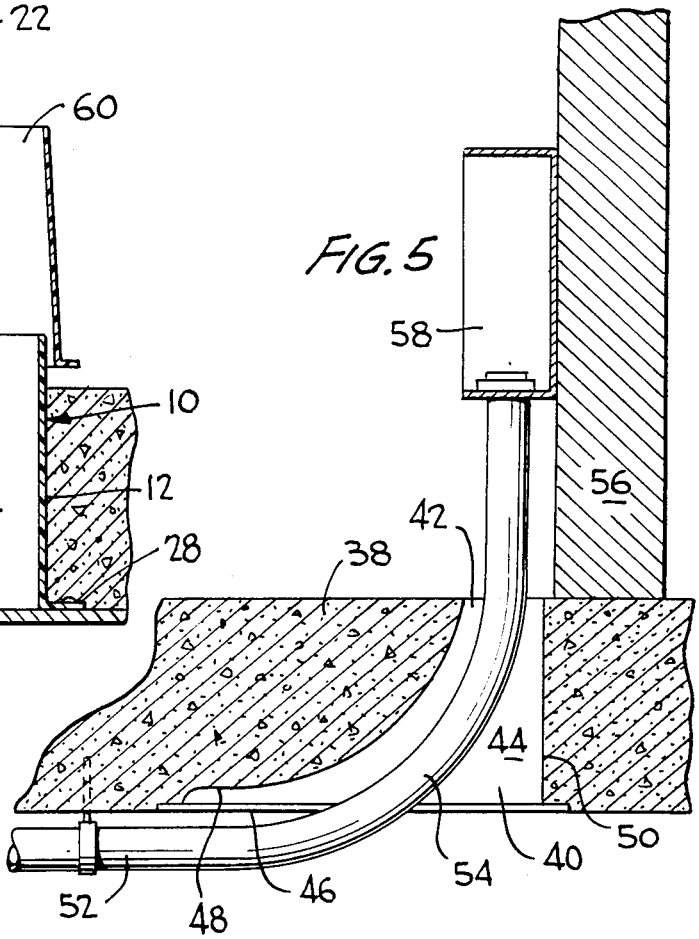
FIG. 5 is a vertical cross-sectional view of the floor slab with the arcuate opening, produced by the form, therein in association with an upstanding wall having an electrical panel or junction box and with the electrical conduit being passed through the opening in the floor.

As shown in FIG. 3, having reference to the formation of the floor slab 38 of FIG. 5, the arcuate boot-like form sleeve has its flange 30 attached to the top of deck form structure 32 by fasteners 34, such as nails, that pass through the apertures 30. The form 10 thus upstands from the horizontal deck form structure 32. If necessary, the interior of the form sleeve 10 may be filled, either partically or entirely and especially at the lower end, with a suitable reinforcing filler, such as cardboard or other inexpensive disposable material. Also, the upper end 20 may be suitably closed off but such is usually not necessary. As can be appreciated from FIG. 3, the concrete is poured on the deck form structure 32 and surrounds the form sleeve 10 so that when the concrete slab 38 is set, as shown in FIG. 5, and the form 10 is removed along with the form structure 32, the slab 38 has an arcuate passage or bore 40. The sleeve form 10 is knocked downwardly, after the form structure is stripped away, by the application of hammer blows and the form 10 can then be discarded.

As can be appreciated from FIG. 5, the passage or bore 40 has a somewhat circular upper open end 42 with the interior 44 of the bore opening sloping downwardly and forwardly toward the larger open bottom end 46. The bore has an upwardly and sidewardly curved front wall 48 and a straight rear wall 50, all of such walls and configurations being replicas of the wall structures of the sleeve form 10.

It can be appreciated that an electrical conduit 52 can be moved axially below the slab 38 parallel with such slab 38 and its forward end portion 54 after being introduced into the front of the upwardly curved or sweeping front of the bore 40 will automatically thread itself into the bore or passage and pass upwardly to the desired height along the upstanding wall 56 to be connected to a junction box 58, for example, mounted on the wall 56.

The boot sleeve form 10, thus, will eliminate the need for offsetting or bending the lead end portion of an electrical conduit or pipe before turning it up into a vertical bore or passage in a poured concrete floor slabl. Such will result in tremendous labor savings and production costs. Also, the passage of conduits or pipes through walls or ceiling can be expedited by the formation of arcuate bores, such as the bore of FIG. 4, therein.

A conventional type plastic sleeve 60, as shown in FIG. 3, may be seated on the upper end 16 of the form when the thickness of the concrete pour will exceed the height of the slip form or boot.

Further, the electrical conduits can be run immediately after forms, such as the deck form structure 32, are stripped. This would result in a reduction of labor costs and time expenditures.

Of course, the boot sleeve form 10 can be made in various sizes so as to produce arcuate bores or passages 40 of differeing sizes for the accommodation of varying diameters of electrical conduits, pipes or the like.

Thus, while the best known form of the present invention has been described herein and shown in the accompanying drawing, the same is merely exemplary and the invention is only limited by the spirit and scope of the appended claims.

What is claimed is:

1. A form for use in forming a through passageway during the pouring of a concrete slab of a predetermined thickness in a building under construction for passing an elongated conduit of a predetermined size through the passageway formed as an arcuate passage gradually extending along and within the thickness of the slab and subsequently perpendicularly extending through the slab for positioning the elongated conduit axially extending along one face of the slab and projecting gradually into and subsequently through the thickness of the slab comprising:

an arcuate sleeve form having a minor end and a major end;

a curved wall structure joining said minor and major ends in a gradual arcuate passageway;

said arcuate sleeve form being in the general shape of a boot having a rounded heel end portion and a rounded and tapered toe end portion, the conduit initially passing into the major end of the arcuate passageway;

said curved wall structure enabling a gradual transition for the conduit initially axially extending along one face of the slab and subsequently fed upwardly therethrough by lengthwise movement for projecting perpendicularly through the slab for enabling conduits to be readily positioned through the concrete slabl without kinking of the conduit.

2. The form of claim 1 wherein said sleeve form is formed in one piece from plastics material.

3. The form of claim 1, and further including an outwardly projecting laterial flange on the major end, said flange having means for securing it on a floor form.

4. The form of claim 1, wherein said minor end projects to a height above the poured slab.

5. The form of claim 1, wherein the sleeve form has a rear wall, side walls and a frontwall, said front wall slopingly curving downwardly from the minor end to the major end and the side walls converging on the toe end portion with the front wall at the major end to produce the tapered rounded toe end portion.

6. The form of claim 5, wherein the sleeve is hollow.

7. The form of claim 5, wherein the sleeve is of one piece tubular construction.

8. The form of claim 7, wherein the sleeve is tubular and is formed from plastics material.

* * * * *